United States Patent [19]

Davison

[11] Patent Number: 4,930,169

[45] Date of Patent: Jun. 5, 1990

[54] APPARATUS FOR PATIENT HYDROTHERAPY AND MANIPULATIVE TREATMENT BY A THERAPIST

[76] Inventor: Kenneth Davison, 7782 Houston Road, Eaton Rapids, Mich. 48827

[21] Appl. No.: 290,426

[22] Filed: Dec. 27, 1988

[51] Int. Cl.[5] ..... A47K 3/00

[52] U.S. Cl. ..... 4/559; 4/546; 4/560; 4/584; 128/846; 600/21

[58] Field of Search ..... 4/541, 542–544, 4/546–547, 559–560, 580, 584, 585, 495, 564, 496, 538, 555; 600/21–22; 128/845–846, 38, 66, 365, 369

[56] References Cited

U.S. PATENT DOCUMENTS

| | | | |
|---|---|---|---|
| 2,417,499 | 3/1947 | Ile | 4/542 |
| 2,514,848 | 7/1950 | Davis | 4/550 |
| 2,560,997 | 7/1951 | Thompson | 4/564 |
| 2,798,229 | 7/1957 | McQuown | 4/564 |
| 3,051,164 | 8/1962 | Trexler | 600/21 |
| 3,373,451 | 3/1968 | Schmidt | 4/585 |
| 3,441,015 | 4/1969 | Oatman et al. | 4/544 X |
| 3,670,718 | 6/1972 | Brendgord | 600/21 |
| 3,719,960 | 3/1973 | Russell | 4/555 |
| 3,864,762 | 2/1975 | Finch | 4/538 |
| 4,007,741 | 2/1977 | Waldrop et al. | 128/846 X |
| 4,192,024 | 3/1980 | Zigmont | 4/496 |
| 4,485,502 | 12/1984 | Marcanio | 4/585 |
| 4,713,850 | 12/1987 | Flaherty et al. | 4/585 |

OTHER PUBLICATIONS

Sutherland (Craniosacral Therapy, Upledger, et al., pp. 5–13, Eastland Press, 1983).

*Primary Examiner*—Henry K. Artis
*Attorney, Agent, or Firm*—Ian C. McLeod

[57] ABSTRACT

An apparatus (10) for fluid treatment and manipulation of a patient (P) by a therapist (T) is described. The apparatus includes open segments (A and B) in tank (12) so that the therapist use his or her body to push a liner (11) inside the enclosure provided by the tank or other support means for the liner. The tank is preferably vertically movable on a frame (13) to adjust to the vertical height of the tank so that the therapist can be in a standing or sitting position. The apparatus increases therapist comfort and effectiveness.

19 Claims, 4 Drawing Sheets

APPARATUS FOR PATIENT HYDROTHERAPY AND MANIPULATIVE TREATMENT BY A THERAPIST

BACKGROUND OF THE INVENTION (1) Field of the Invention

The present invention relates to an apparatus for combined fluid (hydrotherapy) and manipulative treatment of a patient in a tank or other container wherein the therapist can be positioned within the tank enclosure without getting wet. In particular, the present invention relates to a rigid tank with segments removed in the ends or sides and sides so that the therapist can be positioned within the enclosure of the tank with a thin, flexible, inner liner for the tank around the therapist so that he or she does not get wet and is comfortable during the therapy.

(2) Prior Art

The prior art has shown many types of hydrotherapy units. Representative are U.S. Pat. Nos. 2,514,848 to Davis, 3,719,960 to Russel and 3,864,762 to Finch. None of these patents show segments of the tank or tub which can be removed to allow the therapist to move into the enclosure of the tank.

There is a need for combined manipulative and fluid treatment of a patient by a therapist, particularly in the osteopathic treatment of injuries by cranial manipulation. The principal motive for this invention is to combine the art of cranial therapy pioneered by Sutherland (Craniosacral Therapy, Upledger, et al, pages 5–13 (Eastland Press, 1983)) with the art of floatation in high specific gravity (1.3) pioneered by Lilly. The problem has been that the therapist must bend over the sides of the tank, usually in a standing position which is awkward and tiring for the therapist and thus reduces the duration and effectiveness of such treatments.

OBJECTS

It is therefore an object of the present invention to provide an apparatus which allows the therapist, without getting wet, to be essentially inside the enclosure of the tank or other container means while the patient is being subjected to manipulative and fluid treatment. Further, it is an object of the present invention to provide an apparatus which allows the therapist to perform the treatment in comfort and more effectively. Further still, it is an object of the present invention to provide an apparatus which has a tank which is adjustable in vertical height to allow the therapist to use the apparatus in a standing or a sitting position. Further still, it is an object of the present invention to provide an apparatus which is provided with an apron means for protecting the upper body of the therapist from being wetted by the fluid in the tank. Further still it is an object of the present invention to provide an apparatus which is relatively simple and economical to construct. These and other objects will become increasingly apparent by reference to the following description and the drawings.

IN THE DRAWINGS

FIG. 1 is a front view of a tank 12 mounted on a frame 13 with a liner 11 wherein the liner 11 further provides an apron covering the front of a therapist T for treatment of a patient P.

Figure 1:
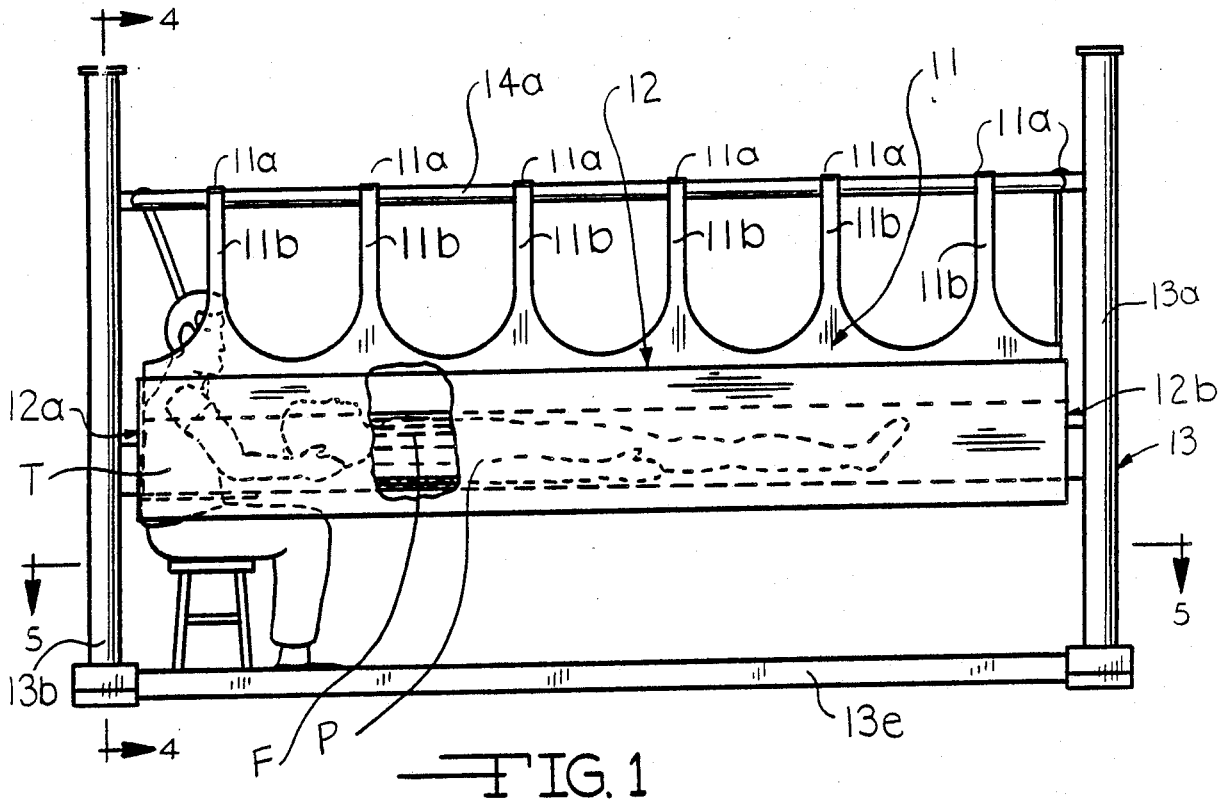
Figure 4:
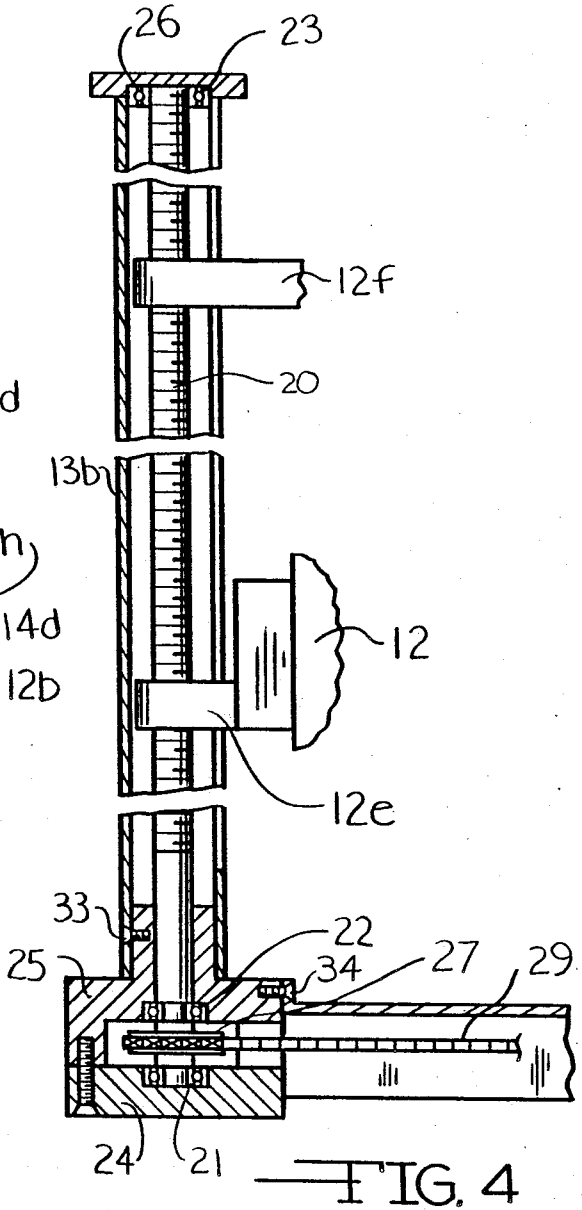

FIG. 4 is a cross-sectional view along line 4—4 of FIG. 1 showing a threaded rod 20 for moving tank 12 vertically on posts 13*a* to 13*d* using chain 29 around gears 27.

Figure 5:
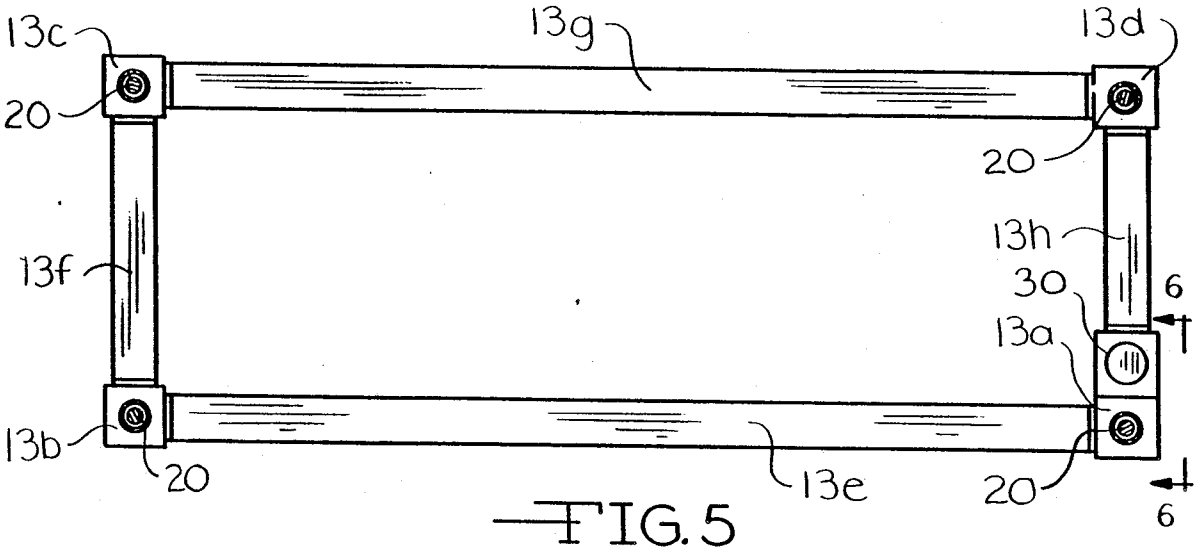

FIG. 5 is a plan cross-sectional view along 5—5 of FIG. 1 showing the position of motor 30 for rotating chain 29.

Figure 6:
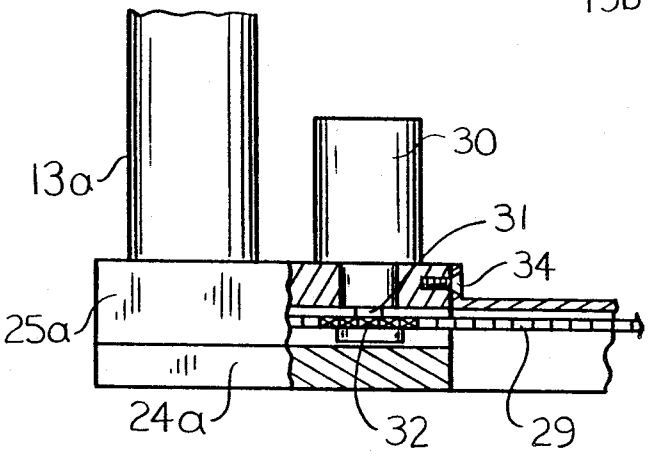

FIG. 6 is a partial front cross-sectional end view between 6—6 of FIG. 5 showing the mounting of the motor 30.

Figure 7:
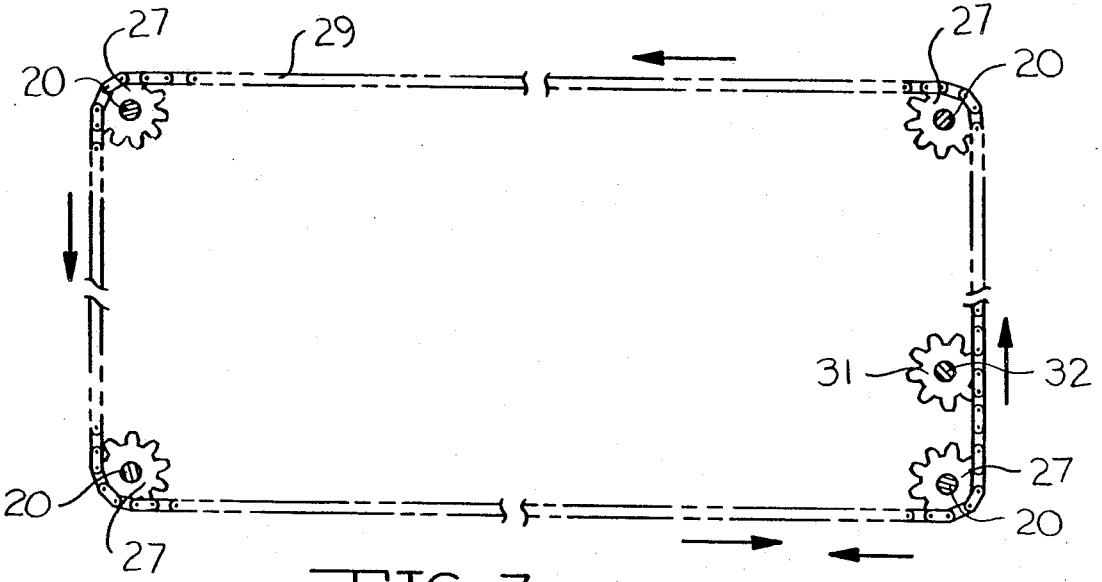

FIG. 7 is a plan view showing the position of chain 29 and gears 27 and 31.

Figure 8:
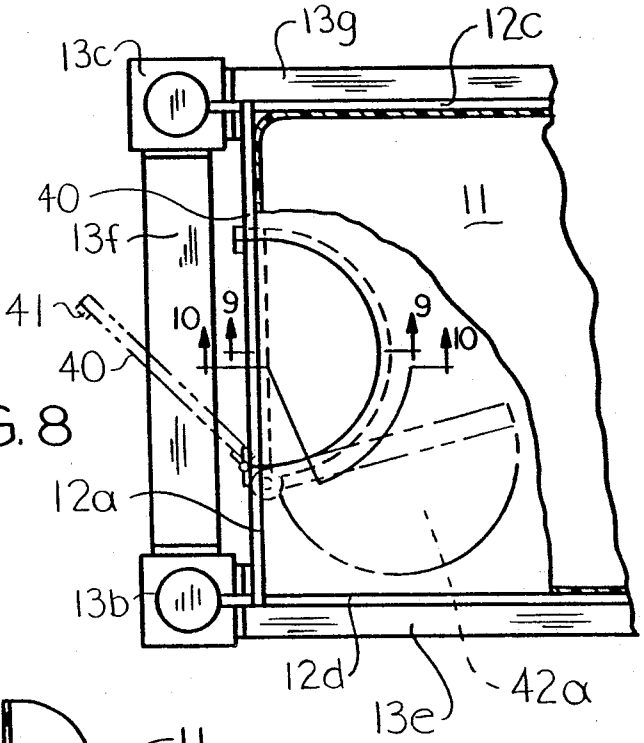

FIG. 8 is a plan view showing a door 40 and removable support 42 for the liner 11.

Figure 9:
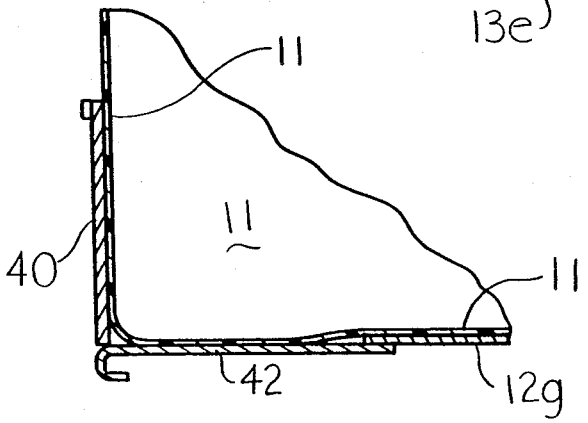

FIG. 9 is a partial front cross-sectional view along line 9—9 of FIG. 8 showing the removable support 42 in a liner 11 supporting position.

Figure 10:
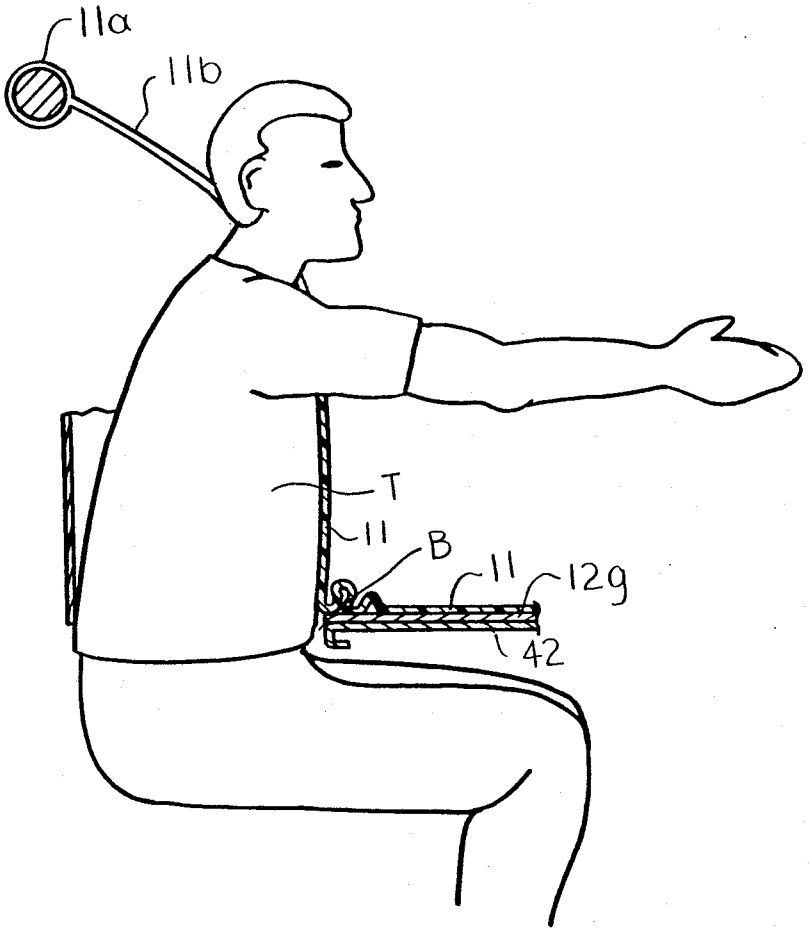

FIG. 10 is a partial cross-sectional view along line 10—10 of FIG. 8 showing the position of the therapist T in tank 12 enclosure in segments A and B.

GENERAL DESCRIPTION

The present invention relates to an apparatus for treating a patient with a fluid and for manipulation of a patient by a therapist in the fluid which comprises: support means having a depth, length and width so as to provide an enclosure which accommodates the patient in the support means, wherein the support means has at least one segment which provides an opening so that a therapist can position an upper body portion within the enclosure of the support means in a standing or sitting position with the arms of the therapist in contact with the patient; and a fluid impermeable liner supported by the support means so as to provide the fluid around the patient, wherein the liner covers the segment and in use the liner is pushed away from the segment into the enclosure by the body of the therapist.

Further the present invention relates to an apparatus for treating a patient with fluid and for manipulation of the patient by a therapist in the fluid which comprises: a rigid tank with a bottom and spaced apart lateral sides and spaced apart ends and having a depth, length and width so as to provide an enclosure which accommodates the patient in the tank, wherein the tank is provided with segments at one of the ends or sides and at the bottom of the tank and wherein a therapist can position an upper body portion in the tank within the enclosure with the arms of the therapist in contact with the patient; and a fluid impenetrable liner mounted within the enclosure of the tank so as to cover the bottom, sides and ends of the tank and so as to provide a fluid around the patient, wherein the liner covers the segment and in use the liner is pushed away from the segment into the enclosure by the body of the therapist.

In the most preferred form, the liner provides an apron which extends above the tank and covers the therapist. The apron can be supported by the apparatus or can be mounted around the neck of the therapist.

The segments preferably have closure means such as doors and/or a removable support for the segments (A and B) which holds the liner in position when the tank is not in use. If the liner is sufficiently thick and the amount of fluid in the tank is limited, the closure means can be eliminated. The door is preferably closed behind the therapist when the tank is in use. This makes it easier for the therapist to counteract the water pressure.

The liner can have an indentation for the therapist at the segment of the tank which is open. This makes it easier for the liner to be pushed into the enclosure of the tank by the therapist. The liner usually would have a length, width and depth which generally accommodates the largest patient to be treated.

Normally the tank would be 8 feet (244 cm) long by 4 feet (122 cm) wide by 10 inches (25.4 cm) 2 feet (61 cm) deep. This allows easy manipulation of the patient.

SPECIFIC DESCRIPTION

Figure 3:
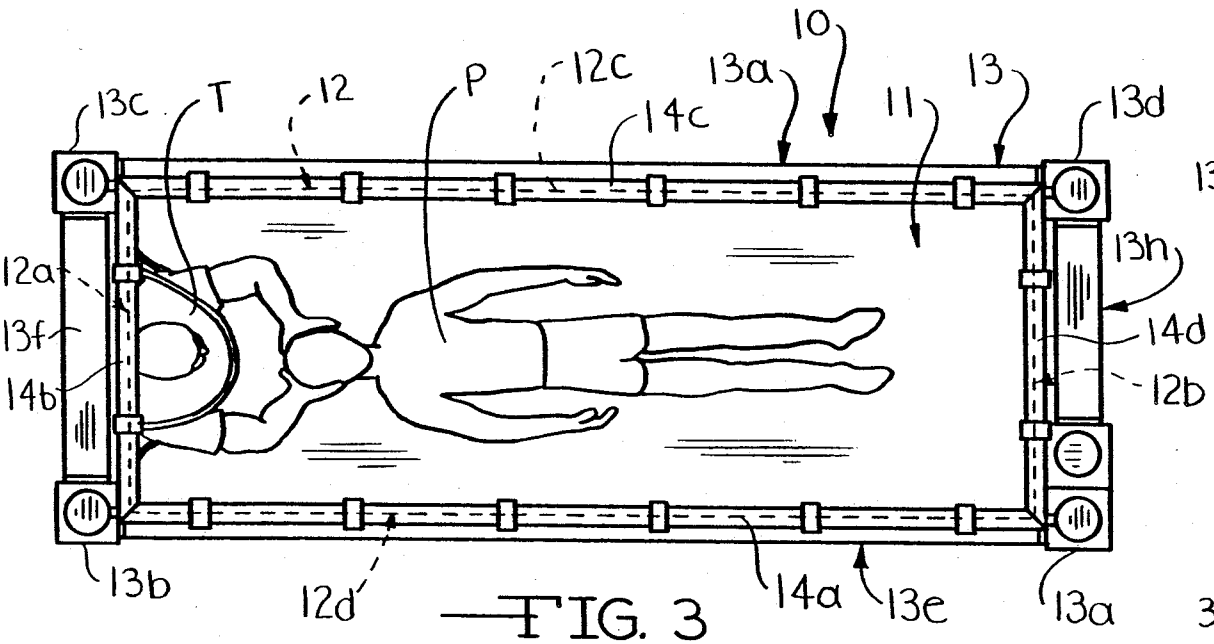
FIG. 3 is a plan view of the tank 12 and frame 13 shown in FIG. 1.

FIGS. 1 and 3 show the preferred apparatus 10 including a flexible, preferably plastic, liner 11 and a rigid tank 12. The tank 12 has opposed ends 12*a* and 12*b* and opposed sides 12*c* and 12*d* so that the tank 12 is preferably generally rectangular in plan view and cross-section A therapist T is positioned within the enclosure of the tank 12 with the liner 11 around him or her in segments in the tank 12 which are open as will be described more fully hereinafter. The therapist T manipulates the patient P.

The tank 12 is supported by a frame 13, including vertically oriented posts 13*a*, 13*b*, 13*c* and 13*d*. Horizontally oriented posts 13*e*, 13*f*, 13*g* and 13*h* of the frame 13 support the posts 13*a*, 13*b*, 13*c* and 13*d*. Horizontal rods 14*a*, 14*b*, 14*c* and 14*d* support loops 11*a* on straps 11*b* which are integral extensions of the liner 11 so that there is an apron around the therapist T. In use the liner 11 is filled with a fluid F.

Figure 2:
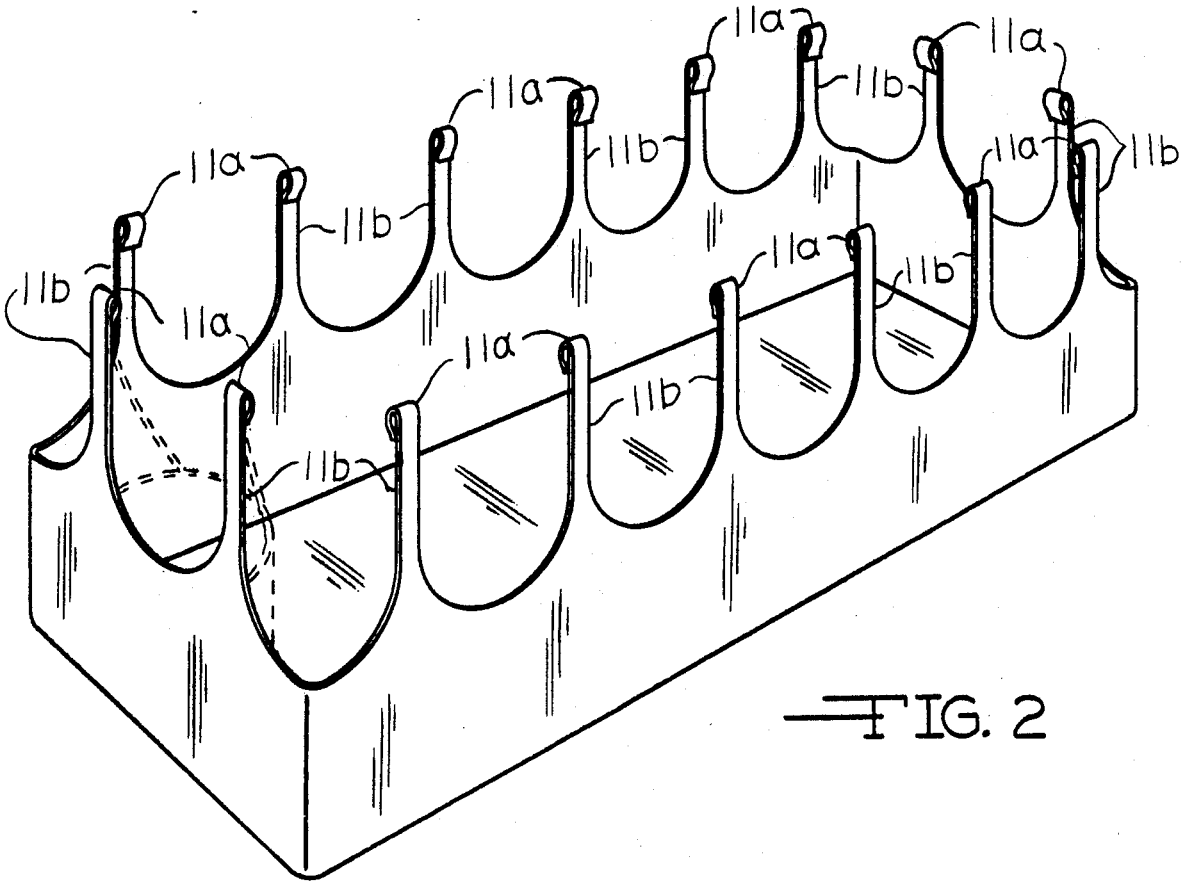
FIG. 2 is a perspective view of the liner 11 removed from the tank 12.

FIG. 2 shows the liner 11 separated from the tank 12 of FIG. 1. The loops 11*a* as shown on straps 11*b*. The dotted lines show how the liner 11 is moved by the therapist T. Straps 11*b* could also be placed around the neck of the therapist T (not shown).

As shown in FIGS. 4 to 7, the tank 12 is preferably moved vertically on posts 13*a* to 13*d*. This movement is accomplished using threaded rods 20 mounted inside the posts 13*a* to 13*d* or bearings 21, 22 and 23 and secured in holders 24, 25 and 26. Extensions 12*e* and 12*f* from tank 12 are mounted on threaded on rods 20. A gear 27 is secured on rod 20 in a space 28 between the holder 24 and 25 adjacent to horizontal posts 13*e* to 13*h*. A horizontally rotatable chain 29 is mounted on gears 27 so as to rotate the gear 27 and rod 20. Each of the posts 13*a* to 13*d* and ends 12*a* and 12*b* of tank has a gear 27 which engages the chain 29 with an identical construction. A motor 30 with a gear 31 on shaft 32 is mounted on horizontal bar 13*f* adjacent post 13*a* so that the gear 31 engages chain 29. The holder 24*a* and 25*a* is enlarged to accommodate the mounting of the motor 30. Various screws 33 or other fasteners secure the posts 13*a* to 13*d* to holder 25 or 25*a*. The horizontal posts 13*e* to 13*h* are held in position on holder 24 or 24*a* by screws 34. Screws 35 hold the holders 24 and 25 (or holders 24*a* and 25*a* (not shown) together.

As can be seen from FIGS. 4 to 7, the motor is actuated by the therapist T. The chain 29 rotates gears 27 so that the tank 12 moves up or down on extensions 12*e* and 12*f*. The motor 30 moves the gear 31 in a clockwise or counterclockwise direction. In this manner the tank 12 is positioned for standing or sitting manipulation of the patient P by the therapist T. Once the adjustment is made, the therapist moves into segments within the enclosure of the tank 12.

FIGS. 8 to 10 show the segment A in the side 12*a* and segment B in the bottom 12*e* of the tank 12. A door 40 with a latch 41 covers the segment A when the tank 12 is not in use. A removable support 42 covers the segment B when the tank 12 is not in use. The support 42 preferably overlaps the bottom 12 of the tank 12.

After the height of the tank 12 is adjusted, the therapist T pushes the liner 11 into the enclosure of the tank 12 by the force of his or her body. The door 40 can then be closed. The straps 11*b* are then over the shoulders of the therapist T. The manipulation of the patient P can then begin. After the treatment is completed the door 40 and removable support 42 are closed to support the liner 11 on the side 12*a* and bottom 12*g* of the tank 12.

The door 40 can be padded (not shown). Also, the front of the therapist T can be padded (not shown) to eliminate any space where the liner 11 is unsupported between the bottom of the tank 12 and the therapist T for greater comfort.

It is intended that the foregoing description be only illustrative of the present invention and that the present invention be limited only by the hereinafter appended claims.

I claim:

1. An apparatus for treating a patient with a fluid and for manipulation of the patient by a therapist in the fluid which comprises:

(a) support means having a depth, length and width so as to provide an enclosure which accommodates the patient in the support means, wherein the support means has at least one segment which provides an opening so that a therapist can position an upper body portion within the enclosure of the support means in a standing or sitting position with the arms of the therapist in contact with the patient; and (b) a fluid impermeable liner supported by the support means so as to provide the fluid around the patient, wherein the liner covers the segment and in use the liner is pushed away from the segment into the enclosure by the body of the therapist.

2. An apparatus for treating a patient with fluid and for manipulation of the patient by a therapist in the fluid which comprises:

(a) a rigid tank with a bottom and spaced apart lateral sides and spaced apart ends and having a depth, length and width so as to provide an enclosure which accommodates the patient in the tank, wherein the tank is provided with segments at one of the ends or sides and at the bottom of the tank and wherein the therapist can position an upper body portion in the tank within the enclosure with the arms of the therapist in contact with the patient; and (b) a fluid impenetrable liner mounted within the enclosure of the tank so as to cover the bottom, sides and ends of the tank and so as to provide a fluid around the patient, wherein the liner covers the segment and in use the liner is pushed away from the segment into the enclosure by the body of the therapist.

3. The apparatus of claim 2 wherein the liner has an extension which extends above the tank to provide an apron over the upper body of the therapist.

4. The apparatus of claim 3 wherein straps of the apron extends across both shoulders of the therapist.

5. The apparatus of claim 2 wherein a removable support covers the segment of the bottom of the tank when the tank is not in use to prevent the liner from tearing when the liner is filled with the fluid and the apparatus is not in use.

6. The apparatus of claim 5 wherein the removable support pivots on the tank adjacent the segment in the bottom of the tank so as to open and close the segment in the bottom of the tank.

7. The apparatus of claim 2 wherein a door covers the open segment in the end or side of the tank which supports the liner to prevent tearing when the liner is filled with the fluid and the apparatus is not in use.

8. The apparatus of claim 5 wherein in addition a door covers the open segment in the end or side of the tank adjacent to the segment in the bottom which supports the liner to prevent tearing when the liner is filled with the fluid and the apparatus is not in use.

9. The apparatus of claim 2 wherein the open segment of the bottom has a rounded lip which reduces the likelihood of tearing of the liner when the tank is filled with the fluid.

10. The apparatus of claim 5 wherein the removable support overlaps an outer surface of the bottom of the tank.

11. The apparatus of claim 7 wherein the door has two spaced apart edges in the open segment in the end or side of the tank and wherein the door on one edge has a latch which holds which engages a projection from the end or side of the tank and wherein the door has a hinge on the other edge mounted on the side or end.

12. The apparatus of claim 3 wherein the apron is supported above the head of the therapist.

13. The apparatus of claim 2 wherein the tank is supported on a frame which allows the therapist to position the upper body in the opening in the tank in a standing or seated position.

14. The apparatus of claim 2 wherein the tank is supported on a frame and wherein the tank is movable in a vertical direction on the frame so as to adjust a height of the tank relative to a vertical height of the therapist in a standing or sitting position.

15. The apparatus of claim 14 wherein the tank is provided with extensions having threaded openings engaged by vertically oriented threaded rods and wherein the tank is raised or lowered by rotation of the threaded rods.

16. The apparatus of claim 15 wherein multiple threaded rods are simultaneously rotated.

17. The apparatus of claim 16 wherein there are at least two threaded rods one at each of the ends of the tank, wherein gears are mounted on a lower end of the threaded rods, wherein a continuous chain is horizontally mounted around each of the gears and wherein actuating means is provided to move the chain on the gears and thus rotate the rods and move the tank in a vertical direction up or down on the rods.

18. The apparatus of claim 17 wherein the actuating means is a motor mounted on the frame with a gear engaging and moving the chain when actuated.

19. The apparatus of claim 1 wherein multiple of the segments are provided around the tank.

* * * * *